US011702603B2

(12) United States Patent
Weiss et al.

(10) Patent No.: US 11,702,603 B2
(45) Date of Patent: Jul. 18, 2023

(54) METHOD FOR CONVERTING FEEDSTOCKS COMPRISING A HYDROCRACKING STEP, A PRECIPITATION STEP AND A SEDIMENT SEPARATION STEP, IN ORDER TO PRODUCE FUEL OILS

(71) Applicant: IFP Energies Nouvelles, Rueil-Malmaison (FR)

(72) Inventors: Wilfried Weiss, Valencin (FR); Isabelle Merdrignac, Chaponnay (FR); Jeremie Barbier, Rive de Gier (FR); Ann Cloupet, Longes (FR)

(73) Assignee: IFP Energies Nouvelles, Rueil-Malmaison (FR)

( * ) Notice: Subject to any disclaimer, the term of this patent is extended or adjusted under 35 U.S.C. 154(b) by 0 days.

(21) Appl. No.: 15/578,467

(22) PCT Filed: Apr. 20, 2016

(86) PCT No.: PCT/EP2016/058747
§ 371 (c)(1),
(2) Date: Nov. 30, 2017

(87) PCT Pub. No.: WO2016/192892
PCT Pub. Date: Dec. 8, 2016

(65) Prior Publication Data

US 2018/0134974 A1 May 17, 2018

(30) Foreign Application Priority Data

Jun. 1, 2015 (FR) ..... 1554962

(51) Int. Cl.
*C10G 31/06* (2006.01)
*C10G 67/02* (2006.01)
(Continued)

(52) U.S. Cl.
CPC ..... *C10G 67/02* (2013.01); *C10G 31/06* (2013.01); *C10G 31/09* (2013.01); *C10G 47/24* (2013.01);
(Continued)

(58) Field of Classification Search
CPC ..... C10G 21/00; C10G 21/003; C10G 31/09; C10G 31/10; C10G 45/00; C10G 47/00;
(Continued)

(56) References Cited

U.S. PATENT DOCUMENTS 2,988,501 A 6/1961 Inwood
4,883,581 A * 11/1989 Dickakian ..... C10G 53/14 208/48 R
(Continued)

FOREIGN PATENT DOCUMENTS

FR 2981659 A1 4/2013
WO 2010004126 A2 1/2010
WO WO-2014096703 A1 * 6/2014 ..... C10G 17/00

OTHER PUBLICATIONS

PubChem, Octadecane, <https://pubchem.ncbi.nlm.nih.gov/compound/octadecane#section=Crystal-Structures>, accessed on Mar. 4, 2020. (Year: 2020).*
(Continued)

*Primary Examiner* — Michelle Stein
(74) *Attorney, Agent, or Firm* — Millen, White, Zelano & Branigan, PC; Ryan Pool

(57) ABSTRACT

The invention concerns a process for converting a hydrocarbon feed, said process comprising the following steps: a) a step of hydrocracking the feed in the presence of hydrogen; b) a step of separating the effluent obtained from step a); c) a step of precipitating sediments, in which the heavy fraction obtained from the separation step b) is brought into contact with a distillate cut at least 20% by weight of which has a
(Continued)

boiling point of 100° C. or more for a period of less than 500 minutes, at a temperature in the range 25° C. to 350° C., and at a pressure of less than 20 MPa; d) a step of physical separation of the sediments from the heavy fraction obtained from step c); e) a step of recovering a heavy fraction having a sediment content, measured using the ISO 10307-2 method, of 0.1% by weight or less.

17 Claims, 1 Drawing Sheet

(51) Int. Cl.
*C10G 31/09* (2006.01)
*C10G 47/24* (2006.01)
*C10G 67/12* (2006.01)

(52) U.S. Cl.
CPC ..... *C10G 67/12* (2013.01); *C10G 2300/1059* (2013.01); *C10G 2300/1077* (2013.01); *C10G 2300/202* (2013.01); *C10G 2300/205* (2013.01); *C10G 2300/206* (2013.01); *C10G 2300/301* (2013.01)

(58) Field of Classification Search
CPC ..... C10G 65/00; C10G 49/002; C10G 49/22; C10G 67/00; C10G 67/0454
See application file for complete search history.

(56) References Cited

U.S. PATENT DOCUMENTS 5,108,580 A * 4/1992 Nongbri ..... C10G 69/04 208/113
5,980,730 A * 11/1999 Morel ..... C10G 69/04 208/100
2007/0284283 A1* 12/2007 Duyvesteyn ..... C10C 3/04 208/4
2008/0011643 A1* 1/2008 Lenglet ..... C10G 67/00 208/58
2011/0167713 A1* 7/2011 Quignard ..... C10G 3/47 44/307
2011/0266198 A1* 11/2011 Hassan ..... C10G 21/003 208/390
2012/0074040 A1* 3/2012 Koseoglu ..... C10G 27/12 208/97
2013/0026074 A1* 1/2013 Koseoglu ..... C10G 31/06 208/309
2013/0081977 A1* 4/2013 Woo ..... C10G 45/58 208/95
2014/0299515 A1 10/2014 Weiss
2016/0010005 A1* 1/2016 Koseoglu ..... C10G 53/14 208/45

OTHER PUBLICATIONS

Pubchem, Hexadecane, <https://pubchem.ncbi.nlm.nih.gov/compound/Hexadecane#section=Color-Form>, accessed on Mar. 4, 2020. (Year: 2020).*
Monument chemical, Advasol HAD heavy aromatic distillate, Safety Data Sheet, Federal Register, vol. 77, No. 58. (Year: 2016).*
Fischer Sci, Aromatic 150 Solvent, Material Safety Data Sheet, <https://fscimage.fischersci.com/msds/91128.htm>, acessed on Mar. 4, 2020. (Year: 2020).*
International Search Report PCT/EP2016/058747 dated Jul. 12, 2017.

* cited by examiner

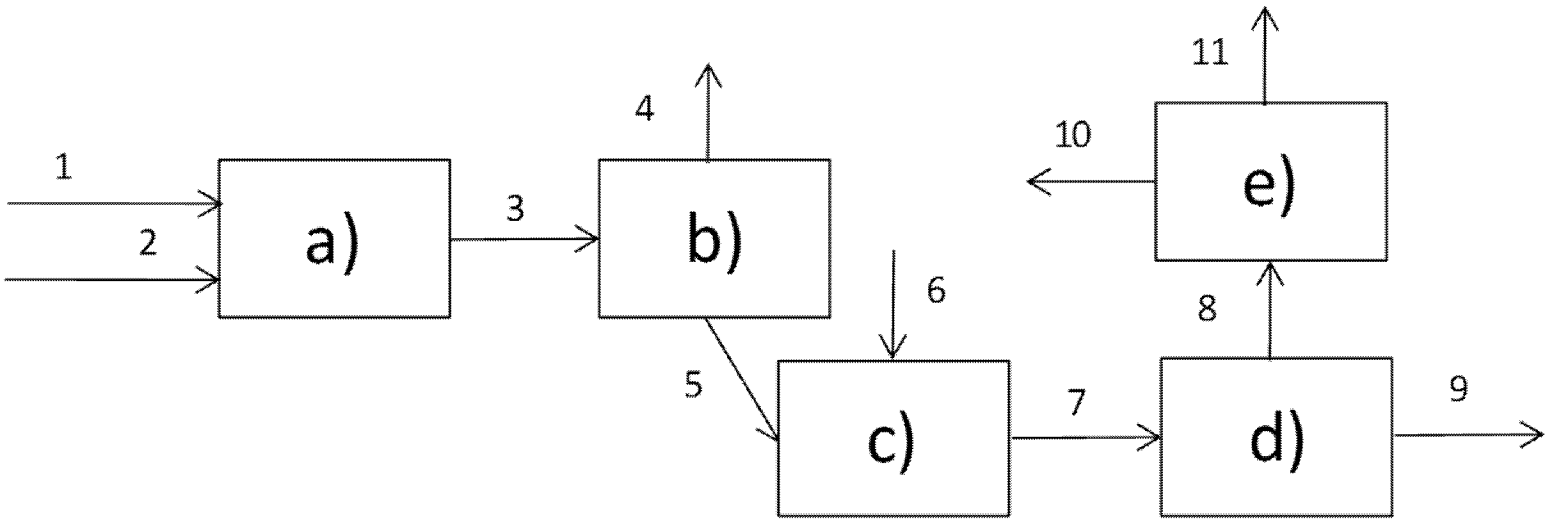
1
2
a)
3
b)
4
5
c)
6
7
d)
8
9
e)
10
11

METHOD FOR CONVERTING FEEDSTOCKS COMPRISING A HYDROCRACKING STEP, A PRECIPITATION STEP AND A SEDIMENT SEPARATION STEP, IN ORDER TO PRODUCE FUEL OILS

The present invention relates to refining and converting heavy hydrocarbon fractions containing sulphur-containing impurities, inter alia. More particularly, it relates to a process for the conversion of heavy oil feeds of the atmospheric residue and/or vacuum residue type for the production of heavy fractions for use as fuel oil bases, in particular bunker fuel bases, with a low sediment content. The process of the invention can also be used to produce atmospheric distillates (naphtha, kerosene and diesel), vacuum distillates and light gases (C1 to C4).

The quality requirements for marine fuels are described in ISO standard 8217. The specification concerning sulphur will from now on concern the emissions of $SO_x$ (Annexe VI of the MARPOL convention from the International Maritime Organisation) and is translated as a sulphur content recommendation of 0.5% by weight or less outside the Emission Control Areas (ECA) for 2020-2025, and 0.1% by weight or less within the ECAs. According to Annexe VI of the MARPOL convention, the sulphur contents mentioned above are equivalent contents leading to $SO_x$ emissions. Thus, a vessel could use a sulphur-containing fuel oil as long as the vessel is equipped with a system for treating fumes allowing the oxides of sulphur emissions to be reduced.

Another very restrictive recommendation is the sediment content after aging in accordance with ISO 10307-2 (also known as IP390), which must be 0.1% or less. The sediment content after aging is a measurement carried out using the method described in ISO standard 10307-2 (also known to the person skilled in the art by the name IP390). Thus, in the remainder of the text, the term "sediment content after aging" should be understood to mean the sediment content measured using the ISO 10307-2 method. The reference to IP390 will also indicate that the measurement of the sediment content after aging is carried out in accordance with the ISO 10307-2 method.

The sediment content in accordance with ISO 10307-1 (also known as IP375) is different from the sediment content after aging in accordance with ISO 10307-2 (also known as IP390). The sediment content after aging in accordance with ISO 10307-2 is a far more restrictive specification and corresponds to the specification which applies to bunker fuels.

Furthermore, onshore fuel oils, in particular fuel oils for use in the production of heat and/or electricity, may also be subject to specifications as regards stability, in particular the maximum sediment contents; the threshold for this varies as a function of the production locations, as there is no international harmonization as is in fact the case for maritime transport. However, there is an interest in reducing the sediment content of onshore fuel oils.

Processes for the hydrocracking of residues can be used to convert low value residues into distillates with a higher added value. The heavy fraction which results therefrom, corresponding to the unconverted residual cut, is generally unstable. It contains sediments which are principally precipitated asphaltenes. This unstable residual cut thus cannot be upgraded as a fuel oil, in particular as a bunker fuel, without a specific treatment once the hydrocracking is operated under severe conditions leading to a high degree of conversion.

The U.S. Pat. No. 6,447,671 describes a process for the conversion of heavy oil fractions, comprising a first ebullated bed hydrocracking step, a step for eliminating particles of catalyst contained in the hydrocracking effluent, then a step for fixed bed hydrotreatment.

Application US 2014/0034549 describes a process for the conversion of residues, employing an ebullated bed hydrocracking step and a step with a reactor termed an upflow reactor associated with a reactor termed a stripper. The sediment content of the final effluent is reduced compared with the effluent from the ebullated bed step. However, the sediment content after aging is not less than 0.1% by weight, as required for commercialisation as a residual type marine fuel.

The patent FR 2 981 659 describes a process for the conversion of heavy oil fractions, comprising a first ebullated bed hydrocracking step and a fixed bed hydrotreatment step comprising permutable reactors.

The hydrocracking process can be used to partially convert the heavy feeds in order to produce atmospheric distillates and/or vacuum distillates. Although ebullated bed technology is known to be suitable for heavy feeds charged with impurities, the nature of the ebullated bed means that it produces catalyst fines and sediments which have to be removed in order to provide a product quality such as bunker fuel. The fines principally originate from attrition of the catalyst in the ebullated bed.

The sediments may be precipitated asphaltenes. Initially in the feed, the hydrocracking conditions and in particular the temperature are such that they undergo reactions (dealkylation, polycondensation etc.), resulting in their precipitation. These phenomena generally arise when operating under severe conditions, giving rise to high levels of conversion (for compounds boiling at more than 540° C.: 540° C.+), for example of more than 30%, 40% or 50%, depending on the nature of the feed.

During the course of its research, the Applicant has developed a novel process integrating a precipitation step and physical separation of the sediments downstream of a hydrocracking step. Surprisingly, it has been discovered that a process of this type can be used to obtain heavy fractions having a low sediment content after aging, said heavy fractions advantageously being able to be used completely or in part as a fuel oil or as a fuel oil base, in particular as bunker fuel or bunker fuel base complying with specifications, namely a sediment content after aging (measured in accordance with the method ISO 10307-2) of 0.1% by weight or less.

One particular advantage of the process in accordance with the invention is that it can avoid the risk of fouling boat engines. Another advantage of the process of the invention is that it avoids the risks of fouling in the case in which any treatment steps are carried out downstream of the hydrocracking step in order to avoid blocking of the catalytic bed or beds employed.

More particularly, the invention concerns a process for the conversion of a hydrocarbon feed containing at least one hydrocarbon fraction having a sulphur content of at least 0.1% by weight, an initial boiling point of at least 340° C. and a final boiling point of at least 440° C., said process comprising the following steps:

a) a step of hydrocracking the feed in the presence of hydrogen in at least one reactor containing a supported ebullated bed catalyst;

b) a step of separating the effluent obtained from step a) into at least one light hydrocarbon fraction containing fuel bases and a heavy fraction containing compounds boiling at at least 350° C., c) a step of precipitating sediments, in which the heavy fraction obtained from the separation step b) is brought into contact with a distillate cut at least 20% by weight of which has a boiling point of 100° C. or more, for a period of less than 500 minutes, at a temperature in the range 25° C. to 350° C., and a pressure of less than 20 MPa, d) a step of physical separation of the sediments from the heavy fraction obtained from the precipitation step c) in order to obtain a heavy fraction separated from the sediments, e) a step of recovering a heavy fraction having a sediment content, measured in accordance with the ISO 10307-2 method, of 0.1% by weight or less, consisting of separating the heavy fraction obtained from step d) from the distillate cut introduced during step c).

In order to constitute a fuel oil complying with the recommendations regarding the viscosity and sediment content after aging, the heavy fractions obtained by means of the present process may be mixed with cutter stocks in a manner such as to obtain the desired target viscosity of the fuel oil grade and the specification as regards the sediment content after aging.

Another point of interest of the process is the partial conversion of the feed in order to produce, in particular by hydrocracking, atmospheric distillates or vacuum distillates (naphtha, kerosene, diesel, vacuum distillate), which can be upgraded as bases in fuel pools, directly or after passing through another refining process such as hydrotreatment, reforming, isomerization, hydrocracking or catalytic cracking.

BRIEF DESCRIPTION OF THE DRAWING

FIG. 1 illustrates a diagrammatic view of the process of the invention which features a hydrocracking zone, a separation zone, a precipitation zone, a zone for the physical separation of sediments and a zone for recovering the fraction of interest.

DETAILED DESCRIPTION

The Feed

The feeds treated in the process of the invention are advantageously selected from atmospheric residues, straight run vacuum residues, crude oils, topped crude oils, deasphalted oils, deasphalting resins, asphalts or deasphalted pitches, residues obtained from conversion processes, aromatic extracts obtained from production lines for lubricant bases, bituminous sands or their derivatives, and oil shales or their derivatives, used alone or as a mixture.

These feeds may advantageously be used as they are, or diluted with a hydrocarbon fraction or a mixture of hydrocarbon fractions which may be selected from products obtained from a fluid catalytic cracking process (FCC, Fluid Catalytic Cracking), a light oil cut (LCO), a heavy oil cut (HCO), a decanted oil (DO), a FCC residue, or from distillation, diesel fractions, in particular those obtained by atmospheric distillation or vacuum distillation such as vacuum diesel, for example. The heavy feeds may also advantageously comprise cuts obtained from the liquefaction of coal or biomass, aromatic extracts, or any other hydrocarbon cuts or indeed non-oilfield feeds such as pyrolysis oil from lignocellulosic biomass.

The feeds of the invention generally have a sulphur content of at least 0.1% by weight, an initial boiling point of at least 340° C. and a final boiling point of at least 440° C., preferably a final boiling point of at least 540° C. Advantageously, the feed may contain at least 1% of C7 asphaltenes and at least 5 ppm of metals, preferably at least 2% of C7 asphaltenes and at least 25 ppm of metals.

The feeds of the invention are preferably atmospheric residues or vacuum residues, or mixtures of these residues.

Step a): Ebullated Bed Hydrocracking

The feed of the invention undergoes a hydrocracking step which is carried out in at least one reactor containing a supported ebullated bed catalyst, preferably functioning in liquid and gas upflow mode. The aim of the hydrocracking step is to convert the heavy fraction into lighter cuts, while at the same time partially refining the feed.

Ebullated bed technology is well known, and so only the principal operating conditions will be described here.

Ebullated bed technologies use supported ebullated bed catalysts in the form of extrudates with a diameter which is generally of the order of 1 mm or less than 1 mm. The catalysts remain inside the reactors and are not evacuated with the products. The temperatures may be high in order to obtain high conversions while minimizing the quantities of catalysts employed. The catalytic activity may be kept constant by replacing the catalyst in-line. Thus, it is not necessary to stop the unit in order to change spent catalyst, nor to increase the reaction temperatures as the cycle progresses in order to compensate for deactivation. In addition, the fact of working under constant operating conditions means that the yields and qualities of the products which are obtained are constant throughout the cycle. In addition, because the catalyst is kept stirred by a substantial recycle of liquid, the pressure drop over the reactor remains small and constant.

The conditions for step a) for hydrocracking the feed in the presence of hydrogen are the usual, conventional conditions for ebullated bed hydrocracking of a liquid hydrocarbon feed. It may advantageously be operated at a partial pressure of hydrogen of 5 MPa to 35 MPa, often in the range 8 MPa to 25 MPa, and more usually in the range 12 MPa to 20 MPa, at a temperature of 330° C. to 500° C., more usually in the range 350° C. to 450° C. The hourly space velocity (HSV) and the partial pressure of hydrogen are important factors which are selected as a function of the characteristics of the product to be treated and the desired conversion. The HSV, which is defined as the volumetric flow rate of the feed divided by the total volume of the reactor, is generally in the range 0.05 $h^{-1}$ to 5 $h^{-1}$, preferably in the range 0.1 $h^{-1}$ to 2 $h^{-1}$ and more preferably in the range 0.2 $h^{-1}$ to 1 $h^{-1}$. The quantity of hydrogen mixed with the feed is usually 50 to 5000 $Nm^3/m^3$ (normal cubic metres ($Nm^3$) per cubic metre ($m^3$) of liquid feed), more usually 100 $Nm^3/m^3$ to 1000 $Nm^3/m^3$ and preferably 200 $Nm^3/m^3$ to 500 $Nm^3/m^3$.

It is possible to use a conventional granular hydrocracking catalyst comprising at least one metal or compound of a metal having a hydrodehydrogenating function on an amorphous support. This catalyst may be a catalyst comprising metals from group VIII, for example nickel and/or cobalt, usually in association with at least one metal from group VIB, for example molybdenum and/or tungsten. As an example, it is possible to use a catalyst comprising 0.5% to 10% by weight of nickel, preferably 1% to 5% by weight of nickel (expressed as nickel oxide, NiO) and 1% to 30% by weight of molybdenum, preferably 5% to 20% by weight of molybdenum (expressed as molybdenum oxide, $MoO_3$) on an amorphous mineral support. This support may, for example, be selected from the group constituted by alumina, silica, silica-aluminas, magnesia, clays and mixtures of at least two of these minerals. This support may also include other compounds, for example oxides selected from the group constituted by boron oxide, zirconia, titanium oxide and phosphoric anhydride. Usually, an alumina support is used, and more usually an alumina support doped with phosphorus and optionally with boron. When phosphoric anhydride, $P_2O_5$, is present, its concentration is normally less than 20% by weight and more usually less than 10% by weight. When boron trioxide, $B_2O_3$, is present, its concentration is usually less than 10% by weight. The alumina used is usually a gamma alumina or eta alumina. This catalyst is usually in the form of extrudates. The total quantity of oxides of metals from groups VI and VIII is usually in the range 5% to 40% by weight, preferably in the range 7% to 30% by weight, and the weight ratio, expressed as the metallic oxide, between the metal (or metals) from group VI and the metal (or metals) from group VIII is in general in the range 20 to 1, and usually in the range 10 to 2.

The spent catalyst is partially replaced with fresh catalyst, generally by withdrawal from the bottom of the reactor, and by introducing fresh or new catalyst into the top of the reactor at regular intervals, i.e., for example, in batches or quasi-continuously. It is also possible to introduce the catalyst via the bottom of the reactor and to withdraw it via the top. As an example, it is possible to introduced fresh catalyst every day. The rate of replacement of spent catalyst with fresh catalyst may, for example, be approximately 0.05 kilograms to approximately 10 kilograms per cubic metre of feed. This withdrawal and replacement are carried out with the aid of devices allowing for continuous operation of this hydrocracking step. The unit usually comprises a recirculation pump for maintaining the catalyst as an ebullated bed by continuously recycling at least a portion of the liquid withdrawn from the head of the reactor and re-injecting it into the bottom of the reactor. It is also possible to send the spent catalyst from the reactor to a regeneration zone in which the carbon and sulphur it contains are eliminated before re-injecting it into the hydrocracking step a).

Usually, the hydrocracking step a) is carried out under the conditions of the H-OIL® process as described, for example, in U.S. Pat. No. 6,270,654.

The hydrocracking may be carried out in a single reactor or in a plurality of reactors (generally two) disposed in series. The fact of using at least two ebullated bed reactors in series means that better quality products can be obtained in a better yield, thereby limiting energy and hydrogen requirements in any subsequent treatments. In addition, hydrocracking in two reactors means that the operability as regards the flexibility of the operating conditions and of the catalytic system is improved. Generally, the temperature of the second ebullated bed reactor is preferably at least 5° C. higher than that of the first ebullated bed reactor. The pressure of the second reactor is 0.1 MPa to 1 MPa lower than that for the first reactor in order to allow at least a portion of the effluent obtained from the first step to flow without the need for pumping. The various operating conditions in terms of temperature in the two hydrocracking reactors are selected in order to be able to control the hydrogenation and the conversion of the feed into the desired products in each reactor. Optionally, the effluent obtained from the first hydrocracking reactor undergoes a separation of the light fraction and at least a portion, preferably all of the residual effluent is treated in the second hydrocracking reactor.

This separation may be carried out in an inter-stage separator such as that described in U.S. Pat. No. 6,270,654 and in particular can be used to avoid hydrocracking of the light fraction in the second hydrocracking reactor which is too intense.

It is also possible to transfer all or a part of the spent catalyst withdrawn from the first hydrocracking reactor, operating at a lower temperature, directly to the second hydrocracking reactor, operating at a higher temperature, or to transfer all or a part of the spent catalyst withdrawn from the second hydrocracking reactor directly to the first hydrocracking reactor. This cascade system has been described in U.S. Pat. No. 4,816,841.

The hydrocracking step may also be carried out in at least one reactor operating in hybrid bed mode, i.e. operating in ebullated bed mode with a supported catalyst associated with a dispersed catalyst constituted by very fine particles of catalyst, together forming a suspension with the feed to be treated.

A hybrid bed comprises two populations of catalyst—a population of ebullated bed type catalyst to which a population of catalyst of a "dispersed" type is added. The term "dispersed" denotes an embodiment of the reactor in which the catalyst is in the form of very fine particles, i.e. generally a size in the range 1 nanometre (i.e. $10^{-9}$ m) to 150 micrometres, preferably in the range 0.1 to 100 micrometres, and more preferably in the range 10 to 80 microns.

In a first variation, the hydrocracking step may comprise a first ebullated bed type reactor followed by a second hybrid bed type reactor (i.e. of the ebullated bed type with an injection of "dispersed" type catalyst).

In a second variation, the hydrocracking step may comprise a first hybrid bed type reactor followed by a second hybrid type reactor.

In a third variation, the hydrocracking step may comprise a single hybrid bed type reactor.

The "dispersed" catalyst used in the hybrid bed reactor may be a sulphurized catalyst preferably containing at least one element selected from the group formed by Mo, Fe, Ni, W, Co, V, Ru. These catalysts are generally monometallic or bimetallic (by combining, for example, a non-noble element from group VIII (Co, Ni, Fe) and an element from group VIB (Mo, W)). The catalysts used may be powders of heterogenic solids (such as natural minerals, iron sulphate, etc.), dispersed catalysts obtained from precursors which are soluble in water, such as phosphomolybdic acid, ammonium molybdate, or a mixture of Mo or Ni oxide with aqueous ammonia. Preferably, the catalysts used are obtained from precursors which are soluble in an organic phase (oil-soluble catalysts).

The precursors are generally organometallic compounds such as Mo, Co, Fe, or Ni naphthenates, or octoates of Mo, or multi-carbonyl compounds of these metals, for example 2-ethyl hexanoates of Mo or Ni, acetylacetonates of Mo or Ni, C7-C12 fatty acids of Mo or W, etc. They may be used in the presence of a surfactant in order to improve the dispersion of the metals, when the catalyst is bimetallic. The catalysts are in the form of dispersed particles, which may or may not be colloidal, depending on the nature of the catalyst. Precursors and catalysts of this type which may be used in the process of the invention have been extensively described in the literature.

In general, the catalysts are prepared before being injected into the feed. The preparation process is adapted to the state of the precursor and its nature. In all cases, the precursor is sulphurized (ex situ or in situ) in order to form the catalyst dispersed in the feed.

In the case of catalysts which are said to be soluble in oil, the precursor is advantageously mixed with a carbonaceous feed (which may be a portion of the feed to be treated, an external feed, a recycled fraction, etc.), the mixture is then sulphurized by adding a sulphur-containing compound (preferably hydrogen sulphide or optionally an organic sulphide such as DMDS in the presence of hydrogen) and heated. The preparations of these catalysts have been described in the literature. The particles of "dispersed" catalysts as defined above (powders of metallic mineral compounds or obtained from water-soluble precursors or oil-soluble precursors) generally have a dimension in the range 1 nanometre to 150 micrometres, preferably in the range 0.1 to 100 micrometres, and more preferably in the range 10 to 80 microns. The catalytic compound content (expressed as the percentage by weight of metallic elements from group VIII and/or group VIB) is in the range 0 to 10% by weight, preferably in the range 0 to 1% by weight.

The additives may be added during the preparation of the catalyst or to the "dispersed" catalyst before it is injected into the reactor. These additives have been described in the literature.

Preferred solid additives are mineral oxides such as alumina, silica, mixed Al/Si oxides, spent supported catalysts (for example on alumina and/or silica) containing at least one element from group VIII (such as Ni, Co) and/or at least one element from group VIB (such as Mo, W). As an example, the catalysts described in application US 2008/177124 may be cited. Carbonaceous solids with a low hydrogen content (for example 4% of hydrogen) such as coke or ground activated carbon, which may have been pre-treated, may also be used. It is also possible to use mixtures of additives of this type. The size of the particles of additive is generally in the range 10 to 750 microns, preferably in the range 100 to 600 microns. The quantity of any solid additive present at the inlet to the reaction zone for the "dispersed" hydrocracking process is in the range 0 to 10% by weight, preferably in the range 1% to 3% by weight, and the catalytic compound content (expressed as the percentage by weight of metallic elements from group VIII and/or group VIB) is in the range 0 to 10% by weight, preferably in the range 0 to 1% by weight.

The hybrid bed reactor or reactors used in the hydrocracking zone are thus constituted by two populations of catalysts, a first population using supported catalysts in the form of extrudates with a diameter which is advantageously in the range 0.8 mm to 1.2 mm, generally 0.9 mm or 1.1 mm, and a second population of catalyst of the "dispersed" type as discussed above.

The particles of catalyst in the ebullated bed are fluidized by using an ebullating pump which can recycle liquid, generally into the interior of the reactor. The flow rate of the liquid recycled by the ebullating pump is adjusted in a manner such that the particles of supported catalyst are fluidized but not transported, and thus in a manner such that these particles remain in the ebullated bed reactor (with the exception of catalyst fines which may be formed by attrition and entrained with the liquid as these fines are very small). In the case of a hybrid bed, the "dispersed" type catalyst is also entrained with the liquid, since the "dispersed" type catalyst is constituted by very small sized particles.

Step b): Separation of Hydrocracking Effluent

The effluent obtained from the hydrocracking step a) undergoes at least one separation step, optionally completed by other supplemental separation steps, in order to separate at least one light hydrocarbon fraction containing fuel bases and a heavy fraction containing compounds boiling at at least 350° C.

The separation step may advantageously be carried out using any method known to the person skilled in the art such as, for example, a combination of one or more high and/or low pressure separators, and/or distillation steps and/or high and/or low pressure stripping steps. Preferably, the separation step b) can be used to obtain a gaseous phase, at least one light naphtha, kerosene and/or diesel type hydrocarbon fraction, a vacuum distillate and a vacuum residue fraction and/or an atmospheric residue fraction. In such a case, the heavy fraction sent to the precipitation step c) corresponds at least in part to an atmospheric residue fraction.

The separation may be carried out in a fractionation section which may initially comprise a high pressure high temperature (HPHT) separator, and optionally a high pressure low temperature (HPLT) separator and/or an atmospheric distillation and/or a vacuum distillation. The effluent obtained from step a) is separated (generally in a HPHT separator) into a light fraction and a heavy fraction mainly containing compounds boiling at at least 350° C. The cut point for the separation is advantageously in the range 200° C. and 400° C.

In a variation of the process of the invention, during step b), the effluent obtained from hydrocracking may also undergo a succession of flash separations comprising at least one high pressure high temperature (HPHT) drum and a low pressure high temperature (LPHT) drum in order to separate a heavy fraction which is sent to a steam stripping step in order to eliminate at least one light fraction which is rich in hydrogen sulphide from said heavy fraction. The heavy fraction recovered from the bottom of the stripping column contains compounds boiling at at least 350° C., but also atmospheric distillates. In accordance with the process of the invention, said heavy fraction separated from the light fraction rich in hydrogen sulphide is then sent to the precipitation step c) and then to the sediments separation step d).

In a variation, at least a portion of the fraction termed the heavy fraction obtained from step b) is fractionated, by atmospheric distillation, into at least one atmospheric distillate fraction containing at least one light naphtha, kerosene and/or diesel type hydrocarbon fraction and an atmospheric residue fraction. At least a portion of the atmospheric residue fraction, corresponding to at least a portion of the heavy fraction obtained from step b), may be sent to the precipitation step c) then to the physical sediment separation step d).

At least a portion of the atmospheric residue may also be fractionated by vacuum distillation into a vacuum distillate containing vacuum diesel and a vacuum residue. Said vacuum residue fraction, corresponding at least in part to the heavy fraction obtained from step b), is advantageously sent at least in part to the precipitation step c) then to the physical sediment separation step d).

At least a portion of the vacuum distillate and/or the vacuum residue may also be recycled to the hydrocracking step a).

Irrespective of the separation method employed, the light fraction(s) obtained may undergo other separation steps, optionally in the presence of the light fraction obtained from an inter-stage separator between the two hydrocracking reactors. Advantageously, it (they) undergo an atmospheric distillation in order to obtain a gaseous fraction, at least one light naphtha, kerosene and/or diesel type hydrocarbon fraction and a vacuum distillate fraction.

A portion of the atmospheric distillate and/or vacuum distillate obtained from the separation step b) may constitute a portion of a fuel oil as a flux. These cuts may also constitute low viscosity marine fuels, (MDO or MGO, Marine Diesel Oil or Marine Gas Oil). Another portion of the vacuum distillate may also be upgraded by hydrocracking and/or fluid catalytic cracking.

The gaseous fractions obtained from the separation step preferably undergo a purification treatment in order to recover hydrogen and recycle it to the hydrocracking reactors (step a)). A portion of the purified hydrogen may be used during the precipitation step.

Upgrading the various fuel base cuts (LPG, naphtha, kerosene, diesel and/or vacuum diesel) obtained in the present invention is well known to the person skilled in the art. The products obtained may be integrated into fuel pools or undergo supplemental refining steps. The naphtha, kerosene, diesel and vacuum diesel fractions may undergo one or more treatments (hydrotreatment, hydrocracking, alkylation, isomerization, catalytic reforming, catalytic cracking or thermal cracking, etc.) in order to bring them up to the required specifications (sulphur content, smoke point, octane number, cetane number, etc.), separately or as a mixture.

Advantageously, the vacuum distillate leaving the ebullated bed after separation may undergo a hydrotreatment. This hydrotreated vacuum distillate may be used as a flux for the fuel oil pool with a sulphur content of 0.5% by weight or less, or it may be upgraded directly as a fuel oil with a sulphur content of 0.1% by weight or less.

A portion of the atmospheric residue, the vacuum distillate and/or the vacuum residue may undergo other supplemental refining steps such as a hydrotreatment step, a hydrocracking step, or a fluid catalytic cracking step.

Step c): Precipitation of Sediments

The heavy fraction obtained at the end of separation step b) contains organic sediments which result from the conditions of the hydrocracking step and the catalyst residues. A portion of the sediments is constituted by asphaltenes precipitated under the hydrocracking conditions, and are analysed as "existing sediments" (IP375).

The sediment content in the heavy fraction varies as a function of the hydrocracking conditions. From the point of view of analysis, existing sediments (IP375) are distinguished from sediments after aging (measured using the ISO 10307-2 method), which includes potential sediments. It should be recalled that intense hydrocracking conditions, i.e. when the rate of conversion is more than 30%, 40% or 50%, for example, depending on the feed, cause the formation of existing sediments and potential sediments.

In order to obtain a fuel oil or a fuel oil base with a reduced sediment content, in particular a bunker fuel or a bunker fuel base which complies with the recommendations for a sediment content after aging (measured using the ISO 10307-2 method) of 0.1% or less, the process of the invention comprises a step for precipitation which can be used to improve the sediment separation efficiency and thus to obtain stable fuel oils or fuel oil bases, i.e. with a sediment content after aging of 0.1% by weight or less.

The precipitation step in accordance with the invention can be used to form all of the existing and potential sediments (by converting the potential sediments into existing sediments) in a manner such as to separate them more efficiently and thus comply with the maximum sediment content after aging (measured using the ISO 10307-2 method) of 0.1% by weight.

The precipitation step in accordance with the invention comprises bringing the heavy fraction obtained from the separation step b) into contact with a distillate cut at least 20% by weight of which has a boiling point of 100° C. or higher, preferably 120° C. or higher, more preferably 150° C. or higher. In a variation of the invention, the distillate cut is characterized in that it comprises at least 25% by weight with a boiling point of 100° C. or higher, preferably 120° C. or higher, more preferably 150° C. or higher.

Advantageously, at least 5% by weight, or even 10% by weight of the distillate cut of the invention has a boiling point of at least 252° C.

More advantageously, at least 5% by weight, or even 10% by weight of the distillate cut of the invention has a boiling point of at least 255° C.

The precipitation step c) in accordance with the invention is advantageously carried out with a dwell time of less than 500 minutes, preferably less than 300 minutes, more preferably less than 60 minutes, at a temperature in the range 25° C. to 350° C., preferably in the range 50° C. to 350° C., preferably in the range 65° C. to 300° C. and more preferably in the range 80° C. to 250° C. The pressure of the precipitation step is advantageously less than 20 MPa, preferably less than 10 MPa, more preferably less than 3 MPa and still more preferably less than 1.5 MPa.

The distillate cut of the invention advantageously comprises hydrocarbons containing more than 12 carbon atoms, preferably hydrocarbons containing more than 13 carbon atoms, more preferably hydrocarbons containing between 13 and 40 carbon atoms.

Said distillate cut may originate wholly or in part from the separation step b) of the invention or from another refining process, or indeed from another chemical process.

Said distillate cut may be used as a mixture with a naphtha type cut and/or a vacuum diesel and/or vacuum residue type cut. Said distillate cut may be used as a mixture with the light fraction obtained from step b), the atmospheric distillate obtained from step b) and/or the vacuum distillate originating from the separation step b). In the case in which the distillate cut of the invention is mixed with another cut, a light fraction and/or a heavy fraction as indicated above, the proportions are selected in a manner such that the resulting mixture has the characteristics of the distillate cut in accordance with the invention.

Using the distillate cut in accordance with the invention has the advantage of dispensing with the use of a lot of high added value cuts such as petrochemical cuts, naphtha cuts, etc.

The weight ratio between the distillate cut in accordance with the invention and the heavy fraction obtained from the separation step b) is in the range 0.01 to 100, preferably in the range 0.05 to 10, more preferably in the range 0.1 to 5, and still more preferably in the range 0.1 to 2. When the distillate cut in accordance with the invention is drawn at least from the process, it is possible to accumulate this cut over a start-up period in order to reach the desired ratio.

The precipitation step may be carried out with the aid of an exchanger or a heating furnace followed by one or more vessel(s) in series or in parallel, such as a horizontal or vertical drum, optionally with a settling function, in order to eliminate a portion of the heaviest solids, and/or a piston reactor. A stirred and heated tank may also be used, and may be provided with a bottom take-off in order to eliminate a portion of the heaviest solids. Advantageously, the precipitation step may be carried out in-line, with no buffer capacity, optionally with the aid of a static mixer.

In a variation, the step c) for precipitating the heavy fraction obtained from step b) is carried out in the presence of an inert gas and/or an oxidizing gas and/or an oxidizing liquid and/or hydrogen, preferably obtained from the separation steps of the process of the invention, in particular the separation step b).

The precipitation step c) may be carried out in the presence of an inert gas such as dinitrogen, or in the presence of an oxidizing gas such as dioxygen, ozone or oxides of nitrogen, or in the presence of a mixture containing an inert gas and an oxidizing gas such as air or nitrogen-depleted air, or in the presence of an oxidizing liquid in order to accelerate the precipitation process. The term "oxidizing agent" means an oxygen-containing compound, for example a peroxide such as hydrogen peroxide, or indeed a mineral oxidizing agent such as a solution of potassium permanganate or a mineral acid such as sulphuric acid. In accordance with this variation, the oxidizing agent is thus mixed with the heavy fraction obtained from the separation step b) and the distillate cut of the invention when carrying out step c).

At the end of precipitation step c), at least one hydrocarbon fraction is obtained with an enriched content of existing sediments which is sent to step d) for separation of the sediments.

Step d): Separation of Sediments

The process of the invention further comprises a step d) of physical separation of the sediments and catalyst residues.

The heavy fraction obtained from precipitation step c) contains precipitated organic sediments of the asphaltene type which are a result of the hydrocracking conditions and the precipitation conditions. This heavy fraction may also contain catalyst fines obtained as the result of attrition of the extrudate type catalysts during operation of the hydrocracking reactor. This heavy fraction may possibly contain "dispersed" catalyst residues in the case in which a hybrid reactor is used.

Thus, at least a portion of the heavy fraction obtained from precipitation step c) undergoes a physical separation of the sediments and catalyst residues by means of at least one physical separation means selected from a filter, a separating membrane, a bed of organic or inorganic type filtration solids, an electrostatic precipitation, a centrifugation system, decanting, or endless screw extraction. A combination, in series and/or in parallel, of a plurality of separation means of the same or different types may be used during this step d) for separation of the sediments and catalyst residues. One of these solid-liquid separation techniques may necessitate the periodical use of a light flushing fraction which may or may not be obtained from the process which, for example, can be used to clean a filter and evacuate the sediments.

The heavy fraction is obtained from the physical sediment separation step d) (with a sediment content after aging of 0.1% by weight or less), comprising a portion of the distillate cut of the invention introduced during step c).

Step e): Recovery of the Heavy Fraction Obtained from Separation Step d)

In accordance with the invention, the mixture obtained from step d) is advantageously introduced into a step e) for recovering the heavy fraction containing a sediment content after aging of 0.1% by weight or less, said step consisting of separating the heavy fraction obtained from step d) from the distillate cut introduced during step c).

Step e) is a separation step which is similar to separation step b). Step e) may be carried out using separator drum and/or distillation column type equipment in order to separate on the one hand, at least a portion of the distillate cut introduced during precipitation step c), and on the other hand the heavy fraction with a sediment content after aging of 0.1% by weight or less.

Advantageously, a portion of the distillate cut separated from step e) is recycled to the precipitation step c).

Said recovered heavy fraction may advantageously act as a fuel oil base or as a fuel oil, in particular as a bunker fuel base or as a bunker fuel, with a sediment content after aging of less than 0.1% by weight.

Advantageously, said heavy fraction is mixed with one or more cutter stocks selected from the group constituted by light cycle oils from catalytic cracking, heavy cycle oils from catalytic cracking, catalytic cracking residue, a kerosene, a diesel, a vacuum distillate and/or a decanted oil.

In a particular embodiment, a portion of the distillate cut of the invention may be left in the heavy fraction with a reduced sediment content in a manner such that the viscosity of the mixture is directly that of a desired fuel oil grade, for example 180 or 380 cSt at 50° C.

Step f): Optional Hydrotreatment Step

The sulphur content of the heavy fraction obtained from step d) or e), and containing mainly compounds boiling at least 350° C., is a function of the operating conditions of the hydrocracking step, but also of the sulphur content of the original feed.

Thus, for feeds with a low sulphur content, generally less than 1.5% by weight, it is possible to directly obtain a heavy fraction with less than 0.5% by weight of sulphur as required in 2020-2025 for vessels without fume scrubbers and operating outside ECAs.

For the feeds containing more sulphur, with a sulphur content which is generally more than 1.5% by weight, the sulphur content of the heavy fraction may exceed 0.5% by weight. In such a case, a fixed bed hydrotreatment step f) is rendered necessary in the case where the refiner wishes to reduce the sulphur content, in particular for a bunker fuel base or a bunker fuel for burning on a vessel without fume scrubbers.

The fixed bed hydrotreatment step f) is carried out on at least a portion of the heavy fraction obtained from step d) or e).

The heavy fraction obtained from step f) may advantageously act as a fuel oil base or as a fuel oil, in particular as a bunker fuel base or as a bunker fuel, having a sediment content after aging of less than 0.1% by weight. Advantageously, said heavy fraction is mixed with one or more cutter stocks selected from the group constituted by light cycle oils from catalytic cracking, heavy cycle oils from catalytic cracking, a catalytic cracking residue, a kerosene, a diesel, a vacuum distillate and/or a decanted oil.

The heavy fraction obtained from step d) or e) is sent to a hydrotreatment step f) comprising one or more fixed bed hydrotreatment zones. Sending a heavy fraction which is free of sediments to a fixed bed constitutes an advantage of the present invention, because the fixed bed is less prone to clogging and to an increase in the pressure drop.

The term "hydrotreatment" (HDT) in particular includes hydrodesulphurization reactions (HDS), hydrodenitrogenation reactions (HDN), and hydrodemetallization reactions (HDM), but also hydrogenation, hydrodeoxygenation, hydrodearomatization, hydroisomerization, hydrodealkylation, hydrocracking, hydrodeasphalting and Conradson Carbon reduction reactions.

A heavy cut hydrotreatment process of this type is well known and may form part of the process known by the name HYVAHL-F™ described in U.S. Pat. No. 5,417,846.

The person skilled in the art will readily appreciate that mainly hydrodemetallization reactions are carried out in the hydrodemetallization step, but at the same time, some hydrodesulphurization reactions occur. Similarly, mainly hydrodesulphurization reactions are carried out in the hydrodesulphurization step, but at the same time, some hydrodemetallization reactions occur.

In accordance with a variation, a co-feed may be introduced into the hydrotreatment step f) with the heavy fraction. This co-feed may be selected from atmospheric residues, straight run vacuum residues, deasphalted oils, aromatic extracts obtained from lubricant base production lines, hydrocarbon fractions or a mixture of hydrocarbon fractions which may be selected from products obtained from a fluid catalytic cracking process: a light cycle oil (LCO), a heavy cycle oil (HCO), a decanted oil, or from distillation, or from diesel fractions, in particular those obtained by atmospheric distillation or vacuum distillation such as, for example, vacuum diesel.

The hydrotreatment step may advantageously be carried out at a temperature in the range 300° C. to 500° C., preferably in the range 350° C. to 420° C., and at a partial pressure of hydrogen which is advantageously in the range 2 MPa to 25 MPa, preferably in the range 10 MPa to 20 MPa, with an overall hourly space velocity (HSV), which is defined as the volumetric flow rate of feed divided by the total volume of catalyst, which is in the range 0.1 $h^{-1}$ to 5 $h^{-1}$, preferably in the range 0.1 $h^{-1}$ to 2 $h^{-1}$, a quantity of hydrogen mixed with the feed which is normally 100 to 5000 $Nm^3/m^3$ (normal cubic metres ($Nm^3$) per cubic metre ($m^3$) of liquid feed), usually 200 to 2000 $Nm^3/m^3$ and preferably 300 to 1500 $Nm^3/m^3$.

Usually, the hydrotreatment step is carried out on an industrial scale in one or more reactors in liquid downflow mode. The hydrotreatment temperature is generally adjusted as a function of the desired degree of hydrotreatment.

The hydrotreatment catalysts used are preferably known catalysts, and are generally granular catalysts comprising, on a support, at least one metal or compound of a metal having a hydrodehydrogenating function. These catalysts may advantageously be catalysts comprising at least one metal from group VIII, generally selected from the group constituted by nickel and/or cobalt, and/or at least one metal from group VIB, preferably molybdenum and/or tungsten. As an example, a catalyst comprising 0.5% to 10% by weight of nickel, preferably 1% to 5% by weight of nickel (expressed as nickel oxide, NiO) and 1% to 30% by weight of molybdenum, preferably 5% to 20% by weight of molybdenum (expressed as molybdenum oxide, $MoO_3$) on a mineral support may be used. This support may, for example, be selected from the group constituted by alumina, silica, silica-aluminas, magnesia, clays and mixtures of at least two of these minerals. Advantageously, this support includes other doping compounds, in particular oxides selected from the group formed by boron oxide, zirconia, cerine, titanium oxide, phosphoric anhydride and a mixture of these oxides. Usually, an alumina support is used, and more usually an alumina support doped with phosphorus and optionally with boron. The concentration of phosphoric anhydride, $P_2O_5$, is normally in the range 0 or 0.1% to 10% by weight. The concentration of boron trioxide, $B_2O_3$, is normally in the range 0 or 0.1% to 10% by weight. The alumina used is normally a γ alumina or η alumina. This catalyst is usually in the form of extrudates. The total quantity of oxides of metals from groups VIB and VIII is usually 5% to 40% by weight, and in general 7% to 30% by weight, and the weight ratio, expressed as the metallic oxide, between the metal (or metals) from group VIB and the metal (or metals) from group VIII, is generally in the range 20 to 1, and usually in the range 10 to 2.

In the case of a hydrotreatment step including a hydrodemetallization step (HDM) then a hydrodesulphurization (HDS) step, specific catalysts which are adapted to each step are preferably used.

Examples of catalysts which may be used in the hydrodemetallization (HDM) step are indicated in patent documents EP 0 113 297, EP 0 113 284, U.S. Pat. Nos. 5,221,656, 5,827,421, 7,119,045, 5,622,616 and 5,089,463. Preferably, hydrodemetallization (HDM) catalysts are used in the permutable reactors. Examples of catalysts which may be used in the hydrodesulphurization (HDS) step are those indicated in patents EP 0 113 297, EP 0 113 284, U.S. Pat. Nos. 6,589,908, 4,818,743 or 6,332,976. It is also possible to use a mixed catalyst, which is active for hydrodemetallization and hydrodesulphurization, both in the hydrodemetallization (HDM) section and in the hydrodesulphurization (HDS) section, as described in patent FR 2 940 143.

Prior to injection of the feed, the catalysts used in the process of the present invention preferably undergo an in situ or ex situ sulphurization treatment.

Step g): Optional Step for Separating the Hydrotreatment Effluent

The process of the invention may comprise a step g) for separating the effluents from the hydrotreatment step f). The optional separation step g) may advantageously be carried out employing any method which is known to the person skilled in the art such as, for example, the combination of one or more high and/or low pressure separators, and/or high and/or low pressure distillation and/or stripping steps. This optional separation step g) is similar to the separation step b) and does not need to be described in any further detail.

In a variation of the invention, part or often all of the effluent obtained from step f) may be sent to a separation step g) comprising an atmospheric distillation and/or a vacuum distillation. The effluent from the hydrotreatment step is fractionated by atmospheric distillation into a gaseous fraction, at least one atmospheric distillate fraction containing fuel bases (naphtha, kerosene and/or diesel) and an atmospheric residue fraction. At least a portion of the atmospheric residue may then be fractionated by vacuum distillation into a vacuum distillate fraction containing vacuum diesel and a vacuum residue.

The vacuum residue fraction and/or the vacuum distillate fraction and/or the atmospheric residue fraction may in part constitute at least fuel oil bases with a low sulphur content having a sulphur content of 0.5% by weight or less and a sediment content after aging of 0.1% or less. The vacuum distillate may constitute a fuel oil base with a sulphur content of 0.1% by weight or less.

A portion of the vacuum residue and/or atmospheric residue may also be recycled to the hydrocracking step a).

Fluxing

In order to obtain a fuel oil, the heavy fractions obtained from steps d) and/or e) and/or f) and/or g) may be mixed with one or more cutter stocks selected from the group constituted by light cycle oils from catalytic cracking, heavy cycle oils from catalytic cracking, catalytic cracking residue, a kerosene, a diesel oil, a vacuum distillate and/or a decanted oil, and the distillate cut in accordance with the invention. Preferably, a kerosene, a diesel oil and/or a vacuum distillate produced in the process of the invention will be used. Advantageously, a kerosene, diesel and/or vacuum distillate obtained in the separation steps b) or g) of the process will be used.

Description of FIG. 1

FIG. 1 diagrammatically shows an exemplary implementation of the invention, without in any way limiting its scope.

The hydrocarbon feed 1 and hydrogen 2 are brought into contact in an ebullated bed hydrocracking zone a). The effluent 3 obtained from the hydrocracking zone is sent to a separation zone b) in order to obtain a light hydrocarbon fraction 4 and a heavy liquid fraction 5 containing compounds boiling at at least 350° C. This heavy fraction 5 is brought into contact with a distillate cut 6 during a precipitation step in the zone c). The effluent 7 constituted by a heavy fraction and sediments is treated in a physical separation step in the zone d) in order to eliminate a fraction comprising the sediments 9 and to recover a liquid hydrocarbon fraction 8 with a reduced sediment content. The liquid hydrocarbon fraction 8 is then treated in a step for recovering, in zone e), on the one hand a liquid hydrocarbon fraction 11 with a sediment content after aging of 0.1% by weight or less, and on the other hand a fraction 10 containing at least a portion of the distillate cut introduced during step c).

EXAMPLES

The following example illustrates the invention without in any way limiting its scope. A vacuum residue (VR Oural) was treated; it contained 84% by weight of compounds boiling at a temperature of more than 520° C., with a density of 9.5° API and a sulphur content of 2.6% by weight.

The feed underwent a hydrocracking step comprising two successive ebullated bed reactors. The operating conditions for the hydrocracking step are shown in Table 1.

TABLE 1

Operating conditions for the hydrocracking section

| Catalysts | 2 ebullated beds NiMo on alumina |
|---|---|
| Temperature R1 (° C.) | 430 |
| Temperature R2 (° C.) | 430 |
| Partial pressure of $H_2$ (MPa) | 15 |
| HSV "reactors" ($h^{-1}$, $Sm^3$/h fresh feed/$m^3$ of reactors) | 0.35 |
| HSV "ebullated bed catalysts" ($h^{-1}$, $Sm^3$/h fresh feed/$m^3$ of ebullated bed catalysts) | 0.65 |
| H2/HC, inlet hydrocracking section without $H_2$ consumption ($Nm^3/m^3$ of fresh feed) | 600 |

The NiMo on alumina catalyst used is sold by Axens under reference HOC-548.

The effluent from the hydrocracking step then underwent a separation step in order to separate a gaseous fraction and a heavy liquid fraction using separators. The heavy liquid fraction was then distilled in an atmospheric distillation column in order to recover the distillates and an atmospheric residue.

Sampling, weighing and analysis steps were used to establish an overall material balance for the ebullated bed hydrocracking step. The yields and sulphur contents for each fraction obtained in the effluent leaving the ebullated bed hydrocracking section are given in Table 2 below:

TABLE 2

Yield (Y) and sulphur content (S) of effluent from hydrocracking section (% by weight/feed)

| Products | Hydrocracking in 2 ebullated beds (430/430° C.) Y (wt %) | S (wt %) |
|---|---|---|
| $NH_3$ | 0.2 | |
| $H_2S$ | 2.3 | |
| C1-C4 (gas) | 4.7 | |
| Naphtha, light (IP-100° C.) | 3.2 | 0.06 |
| Naphtha, heavy (100-150° C.) | 7.8 | 0.05 |
| Kerosene (150° C.-225° C.) | 9.8 | 0.08 |
| Diesel (225° C.-350° C.) | 18.1 | 0.13 |
| Vacuum distillate (350° C.-520° C.) | 36.5 | 0.51 |
| Vacuum residue (520° C.+) | 19.2 | 1.27 |

The atmospheric residue AR was a 350° C.+ cut composed of a vacuum distillate portion (VD) of the effluent and all of the vacuum residue (VR) of the effluent in a proportion of 44% by weight of VD and 56% by weight of VR. This atmospheric residue had a viscosity of 38 cSt at 100° C. A number of treatment variations were carried out on this atmospheric residue AR:

A) a variation A (not in accordance with the invention), in which the atmospheric residue AR was filtered using a metallic porous filter with the trade name Pall®. The sediment content after aging was measured on the atmospheric residue recovered after separation of the sediments;

B) a variation B, in which a precipitation step (in accordance with the invention) was carried out by mixing, with stirring at 80° C. for 1 minute, the atmospheric residue AR and a distillate cut in accordance with the invention in the various proportions described in Table 3.

50% by weight of atmospheric residue (AR) was mixed with 50% by weight of distillate cut in accordance with the invention.

The atmospheric residue which corresponded to the 350° C.+ fraction of the effluent in a proportion of 44% by weight of VD and 56% by weight of VR from the hydrocracking step of the invention was characterized by a sediment content (IP375) of 0.4% m/m and a sediment content after aging (IP390) of 0.9% m/m.

The distillate cut, characterized by the simulated distillation which reflects the percentage distilled as a function of the temperature, contained more than 5% by weight of compounds boiling at more than 255° C. (Table 3).

TABLE 3

Simulated distillation curves for distillate cut

| % by weight distilled | Boiling point (° C.) |
|---|---|
| 5% | 191 |
| 10% | 202 |
| 20% | 222 |
| 30% | 240 |
| 40% | 258 |
| 50% | 276 |
| 60% | 293 |
| 70% | 309 |
| 80% | 325 |
| 90% | 340 |
| 95% | 347 |

The mixture then underwent a step for the physical separation of sediments and catalyst residues using a metallic porous filter with trade mark Pall®. This physical sediments separation step was followed by a step for distilling the mixture in order to recover on the one hand, the atmospheric residue with a reduced sediment content, and on the other hand the distillate cut.

The sediment content after aging was measured on the atmospheric residue recovered after the distillation step. The precipitation and sediments separation data are summarized in Table 4.

TABLE 4

Summary of performances with or without precipitation, separation of sediments and recovery of heavy fraction

| | No precipitation (not in accordance) Proportions of mixture (% m/m) | Mixing, precipitation and separation of sediments (invention) Proportions of mixture (% m/m) |
|---|---|---|
| Proportion of atmospheric residue (AR) in the mixture (% m/m) | 100 | 50 |
| Proportion of distillate cut in the mixture (% m/m) | — | 50 |
| Sediment content in the mixture (measured in accordance with IP375[a] % m/m) | — | 0.79[a] |
| Sediment content of atmospheric residue AR recovered after physical sediments separation (measured in accordance with IP390[b] % m/m) | 0.5[b] | <0.1[b] |

The operating conditions for the hydrocracking step coupled with the various treatment variations (separation of sediments with a precipitation step (B) in accordance with the invention or without step (A) for precipitation of the atmospheric residue (AR)) had an impact on the stability of the effluents obtained. This is illustrated by the sediment contents after aging measured in the atmospheric residues AR (350° C.+ cut) before and after the step for precipitation and separation of the sediments.

Thus, the atmospheric residue obtained in accordance with the invention constitutes an excellent fuel oil base, in particular a bunker fuel base, with a sediment content after aging (IP390) of less than 0.1% by weight.

The atmospheric residue AR treated in accordance with the mixture of Table 4 had a sediment content after aging of less than 0.1%, a sulphur content of 0.93% m/m and a viscosity of 380 cSt at 50° C. This mixture thus constituted a high quality bunker fuel which could be sold with grade RMG or IFO 380, with a low sediment content. It could, for example, be burned within ECAs or outside ECAs for 2020-25 only if the vessel is equipped with a fume scrubber in order to dispose of the oxides of sulphur.

The invention claimed is:

1. A process for the conversion of a hydrocarbon feed containing at least one hydrocarbon fraction having a sulphur content of at least 0.1% by weight, an initial boiling point of at least 340° C. and a final boiling point of at least 440° C., said process comprising the following steps:

a) a step of hydrocracking the feed in the presence of hydrogen in at least one reactor containing a supported ebullated bed catalyst;

b) a step of separating the effluent obtained from step a) into at least one light hydrocarbon fraction containing fuel bases and a heavy fraction containing compounds boiling at least 350° C., c) a step of precipitating sediments, consisting of bringing into contact the heavy fraction obtained from the separation step b) with a distillate cut at least 20% by weight of which has a boiling point of 100° C. or more, for a period of less than 500 minutes, at a temperature in the range of 25° C. to 350° C., a pressure of less than 20 MPa, and in the presence of an oxidizing gas wherein the oxidizing gas is ozone, and wherein part or all of the distillate cut originates from the separation step b), and wherein the distillate cut comprises hydrocarbons containing between 13 and 40 carbon atoms, d) a step of physical separation of the sediments from the heavy fraction obtained from the precipitation step c) to obtain a heavy fraction separated from the sediments, e) a step of recovering a heavy fraction where the heavy fraction is a bunker fuel or a bunker fuel base having a sediment content, measured in accordance with the ISO 10307-2 method, of 0.1% by weight or less, consisting of separating the heavy fraction obtained from step d) from the distillate cut introduced during step c), and wherein the weight ratio between the distillate cut and the heavy fraction obtained from the separation step b) is in the range of 0.05 to 10.

2. The process according to claim 1, further comprising a step f) of fixed bed hydrotreatment carried out on at least a portion of the heavy fraction obtained from step d) or e).

3. The process according to claim 1, in which at least 25% by weight of the distillate cut has a boiling point of 100° C. or more.

4. A process for the conversion of a hydrocarbon feed containing at least one hydrocarbon fraction having a sulphur content of at least 0.1% by weight, an initial boiling point of at least 340° C. and a final boiling point of at least 440° C., said process comprising the following steps:

a) a step of hydrocracking the feed in the presence of hydrogen in at least one reactor containing a supported ebullated bed catalyst;

b) a step of separating the effluent obtained from step a) into at least one light hydrocarbon fraction containing fuel bases and a heavy fraction containing compounds boiling at least 350° C., c) a step of precipitating sediments, consisting of bringing into contact the heavy fraction obtained from the separation step b) with a distillate cut at least 20% by weight of which has a boiling point of 100° C. or more, for a period of less than 500 minutes, at a temperature in the range of 25° C. to 350° C., a pressure of less than 20 MPa, and in the presence of an oxidizing gas wherein the oxidizing gas is ozone, and wherein part or all of the distillate cut originates from the separation step b), and wherein the distillate cut comprises hydrocarbons containing between 13 and 40 carbon atoms, d) a step of physical separation of the sediments from the heavy fraction obtained from the precipitation step c) to obtain a heavy fraction separated from the sediments, e) a step of recovering a heavy fraction wherein the heavy fraction is a bunker fuel or a bunker fuel base having a sediment content, measured in accordance with the ISO 10307-2 method, of 0.1% by weight or less, consisting of separating the heavy fraction obtained from step d) from the distillate cut introduced during step c), and wherein the weight ratio between the distillate cut and the heavy fraction obtained from the separation step b) is in the range of 0.05 to 10, and in which at least 5% by weight of the distillate cut has a boiling point of at least 252° C.

5. The process according to claim 1, in which the distillate cut comprises hydrocarbons containing more than 12 carbon atoms.

6. The process according to claim 1, in which part or all of the distillate cut originates from the separation step b) or from a refining process, or from a chemical process.

7. The process according to claim 1, in which a portion of the distillate cut separated in step e) is recycled to the precipitation step c).

8. The process according to claim 1, in which the hydrocracking step a) is operated at a partial pressure of hydrogen of 5 to 35 MPa, at a temperature of 330° C. to 500° C., at a space velocity of 0.05 $h^{-1}$ to 5 $h^{-1}$, and the quantity of hydrogen mixed with the feed is 50 to 5000 $Nm^3/m^3$.

9. The process according to claim 1, in which the hydrocracking step is carried out in at least one reactor operating in hybrid bed mode.

10. The process according to claim 1, in which the physical separation step d) is carried out by a filter, a separation membrane, a bed of organic or inorganic type filtration solids, an electrostatic precipitation, a centrifuging system, a decantation or an endless screw withdrawal.

11. The process according to claim 1, in which at least a portion of the heavy fraction obtained from step b) is fractionated by atmospheric distillation into at least one atmospheric distillate containing at least one light naphtha, kerosene and/or diesel type hydrocarbon fraction and an atmospheric residue fraction.

12. The process according to claim 1, in which the feed is selected from the group consisting of atmospheric residues, straight run vacuum residues, crude oils, topped crude oils, deasphalted oils, deasphalted resins, asphalts, deasphalted pitches, residues obtained from conversion processes, aromatic extracts obtained from lubricant base production lines, bituminous sands, derivatives of bituminous sands, shale oils, derivatives of shale oils, and mixtures thereof.

13. The process according to claim 12, in which the feed contains at least 1% of C7 asphaltenes and at least 5 ppm of metals.

14. The process according to claim 1, in which the heavy fractions obtained from steps d) and/or e) and/or f) are mixed with one or more cutter stocks selected from the group consisting of light cycle oils from catalytic cracking, heavy cycle oils from catalytic cracking, catalytic cracking residue, a kerosene, a diesel, a vacuum distillate and a decanted oil and the distillate cut, to obtain a fuel oil.

15. The process according to claim 1, wherein the oxidizing gas is obtained from the separation step b).

16. A process for the conversion of a hydrocarbon feed containing at least one hydrocarbon fraction having a sulphur content of at least 0.1% by weight, an initial boiling point of at least 340° C. and a final boiling point of at least 440° C., said process comprising the following steps:

a) a step of hydrocracking the feed in the presence of hydrogen in at least one reactor containing a supported ebullated bed catalyst;

b) a step of separating the effluent obtained from step a) into at least one light hydrocarbon fraction containing fuel bases and a heavy fraction containing compounds boiling at least 350° C., c) a step of precipitating sediments, consisting of bringing into contact the heavy fraction obtained from the separation step b) with a distillate cut at least 20% by weight of which has a boiling point of 100° C. or more, for a period of less than 500 minutes, at a temperature in the range of 25° C. to 350° C., a pressure of less than 20 MPa, and in the presence of an oxidizing gas wherein the oxidizing gas is ozone, and wherein part or all of the distillate cut originates from the separation step b), and wherein the distillate cut comprises hydrocarbons containing between 13 and 40 carbon atoms, d) a step of physical separation of the sediments from the heavy fraction obtained from the precipitation step c) to obtain a heavy fraction separated from the sediments, e) a step of recovering a heavy fraction wherein the heavy fraction is a bunker fuel or a bunker fuel base having a sediment content, measured in accordance with the ISO 10307-2 method, of 0.1% by weight or less, consisting of separating the heavy fraction obtained from step d) from the distillate cut introduced during step c), and wherein the weight ratio between the distillate cut and the heavy fraction obtained from the separation step b) is in the range of 0.05 to 10.

17. The process according to claim 1, in which step c) is a step of precipitating sediments, consisting of bringing into contact the heavy fraction obtained from the separation step b) with a distillate cut at least 20% by weight of which has a boiling point of 100° C. or more, for a period of less than 500 minutes, at a temperature in the range of 25° C. to 350° C., a pressure of less than 20 MPa, and in the presence of only an oxidizing gas.

* * * * *